US005496510A

United States Patent [19]

Capone

[11] Patent Number: 5,496,510

[45] Date of Patent: Mar. 5, 1996

[54] ACRYLONITRILE FILAMENT PROCESS

[76] Inventor: Gary J. Capone, 3302 Cedar Cove, SW., Decatur, Ala. 35603

[21] Appl. No.: 294,516

[22] Filed: Aug. 23, 1994

[51] Int. Cl.[6] ..... D01D 5/06; D01D 5/12; D01D 10/02; D01F 6/18

[52] U.S. Cl. ..... 264/182; 264/178 F; 264/210.5; 264/210.8; 264/211.17; 264/235.6

[58] Field of Search ..... 264/182, 203, 264/178 F, 210.5, 210.8, 211.17, 235.6

[56] References Cited

U.S. PATENT DOCUMENTS

| | | | |
|---|---|---|---|
| 3,088,188 | 5/1963 | Knudsen | 428/359 |
| 3,193,603 | 7/1965 | Rowe, Jr. et al. | 264/182 |
| 3,402,234 | 9/1968 | Borie, Jr. et al. | 264/182 |
| 3,402,235 | 9/1968 | Henderson et al. | 264/182 |
| 3,491,179 | 1/1970 | Chinai et al. | 264/182 |
| 3,514,512 | 5/1970 | Kikuchi et al. | 264/342 R |
| 3,597,501 | 8/1971 | Aotani et al. | 525/230 |
| 3,657,409 | 4/1972 | Ram et al. | 264/182 |
| 3,764,666 | 10/1973 | Murib | 423/645 |
| 3,867,499 | 2/1975 | Morgan | 264/182 |
| 3,878,178 | 4/1975 | Guinn et al. | 526/240 |
| 3,932,577 | 1/1976 | Palethorpe et al. | 264/182 |
| 3,961,890 | 6/1976 | Brusa et al. | 264/182 X |
| 4,001,485 | 1/1977 | Patron et al. | 264/182 X |
| 4,535,027 | 8/1985 | Kobashi et al. | 428/364 |
| 4,659,529 | 4/1987 | Kobashi et al. | 264/182 |

*Primary Examiner*—Leo B. Tentoni

[57] ABSTRACT

A process for making acrylic fibers in which control of polymer composition and spin bath composition provide improved product properties.

10 Claims, No Drawings

ACRYLONITRILE FILAMENT PROCESS

BACKGROUND OF THE INVENTION

This invention relates to a wet-spinning process for making acrylonitrile polymer filaments.

Wet-spinning processes for production of acrylonitrile-polymer filaments are well known. See, for example, U.S. Pat. Nos. 3,088,188 and 3,402,235, the disclosures of which are incorporated hereinby reference. In such processes, an acrylonitrile polymer solution is extruded through a spinnerette submerged in a coagulant bath which generally comprises water and solvent. The solvent in the extruded stream of polymer solution migrates into the bath and solidification of the polymer in filament form results. The polymer is generally stretched (drawn) while still in the coagulation bath to at least partially collapse voids resulting from interchange of polymer solvent and bath liquid. Normally, during coagulation there is an inward diffusion of coagulation bath liquid into the filaments being coagulated and a corresponding outward movement of polymer solvent into the coagulation bath. The solvent and the bath liquid in most prior commercial processes interchange in such a manner that the resulting filaments contain voids or cavities along their lengths which can be seen clearly with an optical phase microscope. Filaments containing these voids or unfilled spaces do not possess the requisite physical properties for some end uses. For example, such filaments exhibit a delustered appearance, lower tenacity, and lower abrasion resistance as compared with filaments not containing voids.

To overcome this physical weakness inherently formed in the filaments, positive after treatment steps during the processing of the filaments normally are taken. The tenacity of the filaments is greatly improved by stretching to molecularly orient the polymer molecules and at least partially collapse these voids. To more fully collapse these voids the filaments may be dried at rather high temperatures under tension, thereby forming a more dense filamentary structure. The tenacity of the filaments is generally satisfactory with such after treatment. However, tenacity is primarily a longitudinal property of the filaments; and satisfactory tenacity, alone, is not the full answer to the attainment of filaments having an optimum balance of properties. In many end uses, the abrasion resistance and the resistance to break upon being flexed (flex life) are highly important. Such properties may be regarded as lateral properties as distinguished from longitudinal properties. While drying under tension gives the illusion of forming filaments without voids, the voids are merely collapsed. Although the collapsed voids do not detract from the longitudinal properties of the filaments to any significant extent, it has been found that lateral stresses cause filaments to splinter or break. In other words, filaments having voids which are merely collapsed are laterally weak.

In addition to the possible presence of the voids which are visible under an optical phase microscope, electron microscopy has shown the existence of a reticulate structure in the filaments displaying a network of submicroscopic pores or interstitial spaces most of which intercommunicate with each other. The pores in freshly spun filaments, that is filaments which have been coagulated without having been subjected to any after treatment producing a pronounced change in the structure, are readily observable under an electron microscope. The polymers comprising the filaments appear to take the form of a latticework of integrally joined strings. The polymer lattice has a pattern resembling that of a fine, extremely small meshwork, although the interstices are usually somewhat irregular in size and shape. The micropores present in filaments produced by ordinary wet-spinning techniques as they leave the coagulating bath are more or less spherical. The distances across these spaces are ordinarily about 250 A. to 3000 A. or greater. The frequency of occurrence of the micropores in the filaments produced by ordinary wet-spinning techniques employing aqueous coagulating baths can be estimated under an electron microscope and is usually $35–90\times10^{14}$ per gram of polymer.

The art has found that the properties of the filaments can be improved substantially by subjecting the filaments to an annealing operation. Annealing can be accomplished by placing the acrylonitrile polymer filaments in a closed chamber, subjecting them to a high temperature and pressure in the presence of wet steam and then evacuating the chamber. This treating cycle is repeated as many times as needed. It will be appreciated that this annealing operation is expensive and time consuming. However, omitting the annealing step in the after treatment of conventionally wet spun acrylic filaments results in filaments having a tendency to splinter or fibrillate; and hence, the filaments have a low abrasion resistance.

Prior to this invention, processes using organic, nonsalt based solvents other than processes using organic solvent systems undesirable for commercial processes did not permit obtaining products with acceptable properties without a high pressure steam annealing step.

It will be appreciated by those skilled in the art that an improved wet-spinning process capable of providing filaments which do not require batch annealing to obtain acceptable properties would constitute a substantive technical achievement.

SUMMARY OF THE INVENTION

This invention provides a process for wet-spinning acrylonitrile polymer filaments. More specifically, a solution of acrylonitrile polymer containing at least 30 microequivalents per gram strong acid groups in N,N-dimethylacetamide (DMAc) or dimethylformamide (DMF), preferably DMAc, is extruded into a water/N,N-dimethylacetamide or water/dimethylformamide coagulation bath. Polymer composition and coagulation bath composition are correlated to result in a calculated Rho value (as hereinafter defined) of at least 0.60. This results in filaments which can be rendered commercially useful without batch annealing or which, if desired, can be conventionally annealed to provide superior properties.

The invention will be understood from the following description of the preferred embodiments.

DESCRIPTION OF THE PREFERRED EMBODIMENTS

The polymer spun in accordance with the present invention will be a polymer of acrylonitrile which may be copolymerized with 0% to 15% by weight of a neutral comonomer—i.e., a comonomer such as vinyl acetate or methyl methacrylate which contains no strong acid groups. The polymer will contain 30 to 250 microequivalents/gm strong acid groups (sulfate or sulfonate groups) which may be provided by the redox couple polymerization process or by copolymerization with acidic comonomers (such as sodium para-sulfophenyl methallylether (SPME), sodium methyl sulfonate, or sodium styrene sulfonate) or both. As the number of strong acid groups in the polymer increase, the range of coagulation bath concentration (hereafter disclosed) capable of providing requisite Rho values (as hereinafter discussed) widens. The polymer is dissolved in N,N-dimethylacetamide (DMAc) or dimethylformamide (DMF) or mixtures thereof which may contain 0% to 3% by weight water. The solution will contain 20% to 26% polymer by weight.

The solution is extruded through a spinnerette (which may be of conventional design) into a coagulating bath. The coagulating bath is maintained at a temperature of from 10° C. to 32° C. and consists essentially of DMAc or DMF (preferably DMAc) or mixtures thereof and water. The molar ratios of solvent to water which will result in the required Rho values are believed related to the rate of water diffusion from the coagulating bath into the polymer solution and the rate of polymer phase separation. It is believed that the water to solvent mole ratio controls the rate of diffusion and that the level of polymer strong acid groups controls the rate of polymer phase separation. A water/solvent mole ratio of about (±0.2) 2/1 appears optimum. At this ratio all the water is associated with the solvent and the system behaves as a single phase coagulant which should provide the slowest rate of diffusion into the coagulating fiber.

Rho values are calculated by the formula:

$$Rho=2.44\ R-1.36$$

in which $R=r_1+r_2-(r_1\times r_2)$; $r_1$ being the rate of water diffusion and being equal to $e^{[(2-W/S)2]}$ where W/S is the water to solvent mole ratio in the coagulating bath; and $r_2$ is the rate of polymer phase separation which is equal to $e^{[(microequivalents\ per\ gram\ of\ sulfate\ and\ sulfonate\ groups-95)/95]}$.

The polymer composition and water to solvent ratio in the coagulation bath are correlated such that fiber density is at least 0.60, preferably at least 0.8 and most preferably 1.0 or higher. Higher Rho values may be less practical because of the expense of copolymer containing very high levels of strong acid groups and/or the tendency of filaments to stick together (marry) in coagulation baths having low W/S ratios.

The specified Rho values are significantly higher than values calculated for conventional wet spinning processes using DMAc or DMF dope and coagulation bath solvent systems. Those skilled in the wet-spinning art will recognize that the present process is primarily characterized by use of copolymers with higher strong acid group levels and/or lower water to solvent ratios in the coagulation bath which combination translates to higher calculated Rho values. Those higher Rho values are believed to correlate with higher as-spun fiber densities (a reduced volume of voids in the fiber matrix) but applicants do not intend to be bound by this theory because fiber density measurement techniques to confirm the theory are not conveniently available.

In addition to selecting polymer and coagulation bath compositions to provide the requisite Rho values, certain other process limitations are observed.

The polymer will be an acrylonitrile polymer containing from 0% to 15% by weight vinyl acetate and having a total of 30 to 250 microequivalents per gram sulfate and/or sulfonate groups. These strong acid groups can conveniently be provided by the acrylonitrile redox couple polymerization or by copolymerization of an acidic comonomer.

The polymer will be extruded as a 20% to 26% by weight solution in which the solvent is DMAc or DMF containing 0% to 3% water by weight.

The coagulation bath will consist essentially of DMAc or DMF and water in a ratio correlated with copolymer strong acid group content to provide the required Rho value. The bath will be maintained at a temperature of from 10° C.–32° C.

Jet stretch, which is the speed of the first stretching roll set contacted by the filaments on exiting the spinnerette divided by the velocity of the polymer solution through the spinnerette, is controlled between 0.2 and 1.0, preferably 0.4 to 0.6. At lower jet stretch, processing difficulties are encountered and at higher jet stretch, void sizes tend to increase.

Wet stretch between 2× and 8× is provided by feeding the filaments into a second higher speed roll set and stretching the wet filaments. At lower wet stretch, low fiber strength results and higher stretch tends to open voids created in the spin bath. Wet stretch of from 3 to 6× is preferred.

The fibers produced by the above described process will generally be treated by "in-line relaxation" or batch annealing prior to final use.

In-line relaxation is achieved by feeding the filaments into a hot water bath, usually 88° C. to boiling and withdrawing the filaments at a slower speed to compensate for shrinkage which takes place in the bath. The relaxed filaments are dried by conventional heated rolls or heated air and are suited for use as is or after being converted to staple without the need for a batch annealing process. This is a major advantage of the present invention since conventionally produced filaments require batch annealing.

If desired, the filaments produced by the process of this invention can be subjected to conventional batch annealing processes in which case it is possible to obtain properties superior to those of conventional process filaments which have been batch annealed.

The invention is further illustrated by the following examples:

EXAMPLE 1

This example, which is provided for purposes of comparison, shows the preparation of an acrylic fiber product using a conventional commercial process and the properties of the resulting product.

A 25% by weight solution of copolymer in a solvent consisting of 99.9% by weight DMAc and 0.1% by weight water is prepared. The copolymer contains 7.4 weight % vinyl acetate and 92.6% acrylonitrile. The copolymer contains 34 microequivalents per gram strong acid groups from the redox couple reaction.

The solution is extruded at a rate of 109 liters/hour through a spinnerette having 40,000 0.076 millimeter diameter capillary openings into a coagulant bath containing 95 liters of a 52% by weight DMAc, 48% water mixture which is maintained at 38° C.

The fibers formed are withdrawn from the coagulation bath by passage through a first roll set operating at a speed of 5.64 meters/minute to give a jet stretch ratio of 0.47 and are passed through water at 98° C. into a second roll set operating at a speed of 33.8 meters/minute to provide a wet stretch of 6×.

The fibers are annealed in a batch process by exposure to 35 PSIG (3.43 bar) steam for 20 minutes. A water emulsion of finish is circulated through the fiber bundle at 98° C. and the fibers dried by passage over a hot roll heated by 90 PSIG (7.22 bar) steam.

The fibers produced are 5 denier per filament (5.5 decitex). The copolymer used in this example contains 34 microequivalents/gm strong acid groups and the W/S ratio of the coagulation bath is 4.47. Thus, Rho is calculated as being 0.26.

The fiber produced is typical of conventional 5 dpf commercial fibers and has acceptable properties for use in flat woven upholstery and sweater fabrics.

EXAMPLE 2

This example illustrates the production of acrylic fibers by the process of this invention and the properties of the products obtained.

A 25% by weight solution of copolymer in a solvent consisting of 99.25% by weight DMAc and 0.75% by weight water is prepared. The copolymer contains 6.3 weight % vinyl acetate, 48 microequivalents per gm strong acid groups as a combination of polymer end groups and SPME comohomer and 93.4% acrylonitrile. The solution is extruded at a rate of 109 liters/hour through a spinnerette having 40,000 5 mil (0.076 millimeter) capillary openings into a coagulant bath containing 95 liters of a 71% by weight DMAc, 29% water mixture maintained at 30° C. The fibers formed are withdrawn from the coagulation bath by passage through a first roll set operating at a speed of 5.64 meters/minute to give a jet stretch ratio of 0.57 and are passed through 98° C. water into a second roll set operating at a speed 24.2 meters/minute to provide a wet stretch of 4.3×.

The fiber is provided in-line relaxation by passage from the second roll set through a 98° C. water bath into a third roll set of rolls operating at a speed of 65 ft/min (19.8 meters/minute). No batch process annealing is provided. Finish is applied as in Example 1 and the fibers dried by passage of a roll heated with 90 PSIG (7.22 bar) steam. The resulting fiber product is 5 denier per filament (5.5 decitex). The polymer used has a strong acid group concentration of 48 microequivalents per gram and the W/S ratio of the coagulation bath is 1.97. thus, Rho is calculated as being 1.09. In a Wyzenbeck test (ASTM D3597), a fabric made from staple yarn made from fibers produced via this example withstands over twice as many cycles as fabric made from staple spun from fibers produced according to Example 1.

EXAMPLE 3

This example compares a product produced by the process of this invention and subjected to batch process annealing with a conventional bath process annealed product.

A 25% by weight solution of a copolymer in a solvent consisting of 99.25% DMAc and 0.75% water is prepared. The copolymer contains 6.3 weight % vinyl acetate and 93.7% acrylonitrile with 48 microequivalents/gm strong acid end groups from the redox couple polymerization. The solution is extruded at a rate of 93 liters/hour through a spinnerette having 60,000 2.5 mil ( 0. 063 millimeter) capillary openings into a coagulant bath containing 95 liters of a 69% DMAc, 31% water mixture which is maintained at 30° C.

The fibers are withdrawn from the coagulation bath with a jet stretch ratio of 0.48 and given a 4.77 wet stretch. Finish is applied as in previous examples and the fibers dried.

The fibers are batch annealed by exposure to 40 PSIG (3.77 bar) steam for 20 minutes.

The resulting fibers are 5 denier per filament (5.5 decitex). The polymer used contains 48 microequivalents/gm strong acid groups and the W/S ratio of the coagulation bath is 2.17. Rho is calculated as being 0.998.

To produce a conventional "control" fiber, the above procedure is repeated except that the copolymer dope is a 25% solution of copolymer in a solvent consisting of 99.9% DMAc and 0.1% water. The copolymer contains 7.4 weight % vinyl acetate, 34 microequivalents of strong acid groups from the redox couple acrylonitrile polymerization system and 92.6% acrylonitrile. In the "control" process, the coagulation bath is a mixture of 52% DMAc and 48% water maintained at 35° C. The fiber is withdrawn at a jet stretch of 0.59 and wet stretched 5.66×. The resulting product is 5 denier per filament (5.5 decitex) and has a calculated Rho of 0.26.

The product produced by the process of the invention and the control are both commercially acceptable products. However, in a Wyzenbeck test, fabrics prepared from spun staple yam prepared from fibers produced according to the invention withstand over twice as many cycles as comparable fabrics made from control fiber yams.

The invention has been described and exemplified by reference to specific embodiments. Other embodiments within the scope of the appended claims will be apparent to those skilled in the art.

What is claimed is:

1. A process for making acrylonitrile polymer filaments comprising the steps of:

(a) extruding a solution of acrylonitrile polymer into a coagulation bath to form filaments thereof; wherein said acrylonitrile polymer comprises at least 85 percent by weight acrylonitrile monomer units and up to 15 percent by weight neutral comonomer units; wherein said acrylonitrile polymer has from 30 to 250 microequivalents per gram of sulfate groups, sulfonate groups or a combination thereof; wherein said solution comprises solvent consisting of N,N-dimethylacetamide, dimethylformamide or a mixture thereof, 20 to 26 percent by weight of said acrylonitrile polymer and 0 to 3 percent by weight water; wherein said coagulation bath is at a temperature in the range of 10° C. to 32° C.; and wherein said coagulation bath comprises water and said solvent in a mole ratio selected such that Rho, as defined by the formula Rho=2.44 R−1.36, is greater than 0.6, where $R=r_1+r_2-(r_1 \times r_2)$, $r_1=e^{[(2-W/S)/2]}$,
W is the moles of water in said coagulation bath,
S is the moles of solvent in said coagulation bath, and
$r_2=e^{[(\textit{microequivalents per sulfate and sulfonate groups}-95)/95]}$;

(b) withdrawing said filaments from the bath with a jet stretch of from 0.2 to 1; and (c) providing said filaments with a wet stretch of 2 to 8.

2. The process of claim 1 wherein the jet stretch is from 0.4 to 0.6 and the wet stretch is from 3 to 6.

3. The process of claim 2 wherein Rho is at least 0.8.

4. The process of claim 2 wherein the solvent is N,N-dimethylacetamide.

5. The process of claim 4 wherein the acrylonitrile polymer contains a copolymerized acidic comonomer.

6. The process of claim 4 wherein the acrylonitrile polymer contains a copolymerized neutral comonomer.

7. The process of claim 4 wherein the acrylonitrile polymer contains a copolymerized neutral comonomer and a copolymerized acidic comonomer.

8. The process of claim 4 wherein the water to solvent ratio is about 2.

9. The process of claim 8 further comprising subjecting the filaments to an in-line relaxation step.

10. The process of claim 7 wherein Rho is at least 0.8.

* * * * *

UNITED STATES PATENT AND TRADEMARK OFFICE

CERTIFICATE OF CORRECTION

PATENT NO. : 5,496,510

DATED : Mar. 5, 1996

INVENTOR(S) : Gary J. Capone

It is certified that error appears in the above-indentified patent and that said Letters Patent is hereby corrected as shown below:

In claim 1, column 6, line 42, insert the word --gram-- between the words "per" and "sulfate".

Signed and Sealed this

Twenty-fourth Day of September, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,496,510

DATED : Mar. 5, 1996

INVENTOR(S) : Gary J. Capone

It is certified that error appears in the above-indentified patent and that said Letters Patent is hereby corrected as shown below:

On the title page, item [73] insert --Assignee: Monsanto Company, St. Louis, Mo.--

Signed and Sealed this

Eighth Day of April, 1997

*Attest:*

Bruce Lehman

BRUCE LEHMAN

*Attesting Officer*

*Commissioner of Patents and Trademarks*